US007086544B1

(12) United States Patent
Doench

(10) Patent No.: US 7,086,544 B1
(45) Date of Patent: Aug. 8, 2006

(54) SUPPORT ASSEMBLY FOR A HANGER BAR

(75) Inventor: Jonathan Doench, Cincinnati, OH (US)

(73) Assignee: Schulte Corporation, Cincinnati, OH (US)

( * ) Notice: Subject to any disclaimer, the term of this patent is extended or adjusted under 35 U.S.C. 154(b) by 112 days.

(21) Appl. No.: 10/643,211

(22) Filed: Aug. 18, 2003

Related U.S. Application Data

(60) Provisional application No. 60/404,023, filed on Aug. 16, 2002.

(51) Int. Cl.
*A47H 1/00* (2006.01)

(52) U.S. Cl. ..... 211/105.1; 211/106.1; 211/123; 248/243; 248/304; 248/222.51

(58) Field of Classification Search ..... 211/85.3, 211/16, 88.04, 90.01, 90.03, 94.03, 105.1, 211/106.1, 123, 153, 119; 248/243, 248, 248/304, 222.12, 222.51, 222.52; D6/548
See application file for complete search history.

(56) References Cited

U.S. PATENT DOCUMENTS

| | | | | |
|---|---|---|---|---|
| 576,110 | A * | 2/1897 | Graves | 248/248 |
| 2,837,219 | A * | 6/1958 | Ferdinand et al. | 108/65 |
| 2,987,289 | A * | 6/1961 | Wamsley | 248/341 |
| 3,041,033 | A * | 6/1962 | Schwartz | 248/248 |
| 3,141,556 | A | 7/1964 | Klosterman | |
| 3,191,777 | A * | 6/1965 | Willits, Jr. | 211/106.01 |
| 3,469,710 | A * | 9/1969 | Vosbikian | 211/116 |
| 4,671,419 | A | 6/1987 | Beverly | |
| 4,828,122 | A * | 5/1989 | Day | 211/105.1 |
| D349,000 | S | 7/1994 | Rogers et al. | |
| 5,350,072 | A | 9/1994 | Rogers et al. | |
| 5,351,842 | A | 10/1994 | Remmers | |
| D352,195 | S | 11/1994 | Rogers et al. | |
| D354,864 | S | 1/1995 | Kokenge et al. | |
| 5,405,026 | A | 4/1995 | Lee et al. | |
| 5,531,416 | A | 7/1996 | Remmers | |
| 5,626,245 | A | 5/1997 | Kokenge et al. | |
| 5,758,851 | A | 6/1998 | Remmers | |
| 5,836,461 | A | 11/1998 | Kokenge et al. | |
| D419,344 | S | 1/2000 | Greene | |
| 6,053,465 | A | 4/2000 | Kluge | |
| D427,466 | S | 7/2000 | Remmers | |
| D437,515 | S | 2/2001 | Remmers et al. | |
| D455,065 | S | 4/2002 | Berg | |
| 2004/0035996 | A1 * | 2/2004 | Magnusson | 248/304 |
| 2005/0022950 | A1 * | 2/2005 | Putman | 160/330 |

FOREIGN PATENT DOCUMENTS

| | | |
|---|---|---|
| GB | 1291401 | 10/1972 |
| SE | 164969 | 10/1958 |

OTHER PUBLICATIONS

*elfa Assembly and Installation Guide*, Jan. 2001.

* cited by examiner

*Primary Examiner*—Blair M. Johnson
(74) *Attorney, Agent, or Firm*—Dinsmore & Shohl LLP

(57) ABSTRACT

The present invention relates to a support bracket for a hanger bar. The support bracket has a body having an aperture that receives an upper portion of a support hook. The body also has at least two protrusions that secure the support hook to the body.

17 Claims, 6 Drawing Sheets

SUPPORT ASSEMBLY FOR A HANGER BAR

CROSS-REFERENCE TO RELATED APPLICATIONS

This application claims the benefit of U.S. Provisional Application No. 60/404,023, filed Aug. 16, 2002 which is hereby incorporated by reference.

FIELD OF THE INVENTION

The present invention relates to a support assembly for a hanger bar and a method of supporting a hanger bar.

BACKGROUND OF THE INVENTION

Wire shelving is growing increasingly common in homes and businesses due to its low-cost and durable nature. Wire shelving may be securely mounted to a wall using various types of brackets and fasteners. Alternatively, vertical standards having one or more vertical rows of apertures (or slots) may be secured to a wall, with the wire shelving supported by brackets configured to engage one or more of the apertures of the standards. In this latter arrangement, the height of the wire shelving may be adjusted by moving the brackets to engage another set of apertures. The brackets used to support wire shelving with respect to slotted (or apertured) standards typically can also be used to support other types of shelving (such as solid shelving made of wood or other materials).

Shelving is often used in residences and other locations at which it is desirable to hang items of clothing. In fact, some wire shelving include an integral hanger rod which is positioned beneath the wire shelf, typically directly beneath the front edge of the shelving (or sometimes spaced somewhat rearwardly of the front edge). Other wire shelving, however, do not include an integral hanger bar, and adding a hanger bar to an existing installation will often require the purchase of entirely new wire shelving. In other words, it is often not possible to add a hanger rod to existing wire shelving. In the case of solid shelving supported by traditional brackets and standards, it is similarly difficult to add a hanger rod to such installations.

An additional problem often associated with traditional hanger bar designs is that the support members used to attach the hanger bar to the shelving will interfere with the sliding of a hanger along the hanger bar. In fact, it is not uncommon for the support brackets to limit the ability to slide a hanger across the entire length of the hanger bar. Although U.S. Pat. No. 5,836,461, which is incorporated herein by way of reference, provides a solution to this problem, it is difficult to retrofit existing wire shelving (or, for that matter, other types of shelving) with the support hooks and hanger rod disclosed in this patent.

SUMMARY OF THE INVENTION

One embodiment of the invention is a support bracket for a hanger bar. The support bracket comprises a body having an aperture configured to receive a first portion of a support hook. The body also has at least two protrusions configured to secure the support hook to the body.

Another embodiment of the present invention is a support assembly for supporting a hanger bar. The support assembly comprises a support hook having a first end and a second end. The support assembly also comprises a support bracket comprising a body having an aperture configured to receive the first end of the support hook, and at least two protrusions configured to secure the support hook to the body.

Yet another embodiment of the present invention is a method of supporting a hanger bar. The method of supporting the hanger bar comprises the step of providing a support bracket. The support bracket comprises a body having an aperture configured to receive a first portion of a support hook and at least two protrusions configured to secure the support hook to the body.

In addition to providing support for a hanger bar, the support assembly and bracket of the present invention are also configured to support a shelving member or unit, such as wire shelving or even a solid shelving member (such as a wood shelf).

One of the advantages of the present invention is that the support assembly of the present invention allows for easy installation or removal of hanger bars. Moreover, the design of the support assembly allows hangers on the hanger bar to slide across the entire bar without interruption by the support hooks or any other component of the shelving unit. Lastly, the support assembly allows existing shelving units to be retrofitted with appropriate support brackets.

Still other objects, advantages and novel features of the present invention will become apparent to those skilled in the art from the following detailed description, which is simply, by way of illustration, various modes contemplated for carrying out the invention. As will be realized, the invention is capable of other different aspects all without departing from the invention. Accordingly, the drawings and descriptions are illustrative in nature and not restrictive.

BRIEF DESCRIPTION OF THE DRAWINGS

While the specification concludes with claims particularly pointing out and distinctly claiming the present invention, it is believed that the same will be better understood from the following description, taken in conjunction with the accompanying drawings, in which:

DETAILED DESCRIPTION OF EXEMPLARY EMBODIMENTS

Reference will now be made in detail to the exemplary embodiments of the present invention illustrated in the accompanying drawings, wherein like numerals indicate corresponding elements throughout the views.

Figure 1:
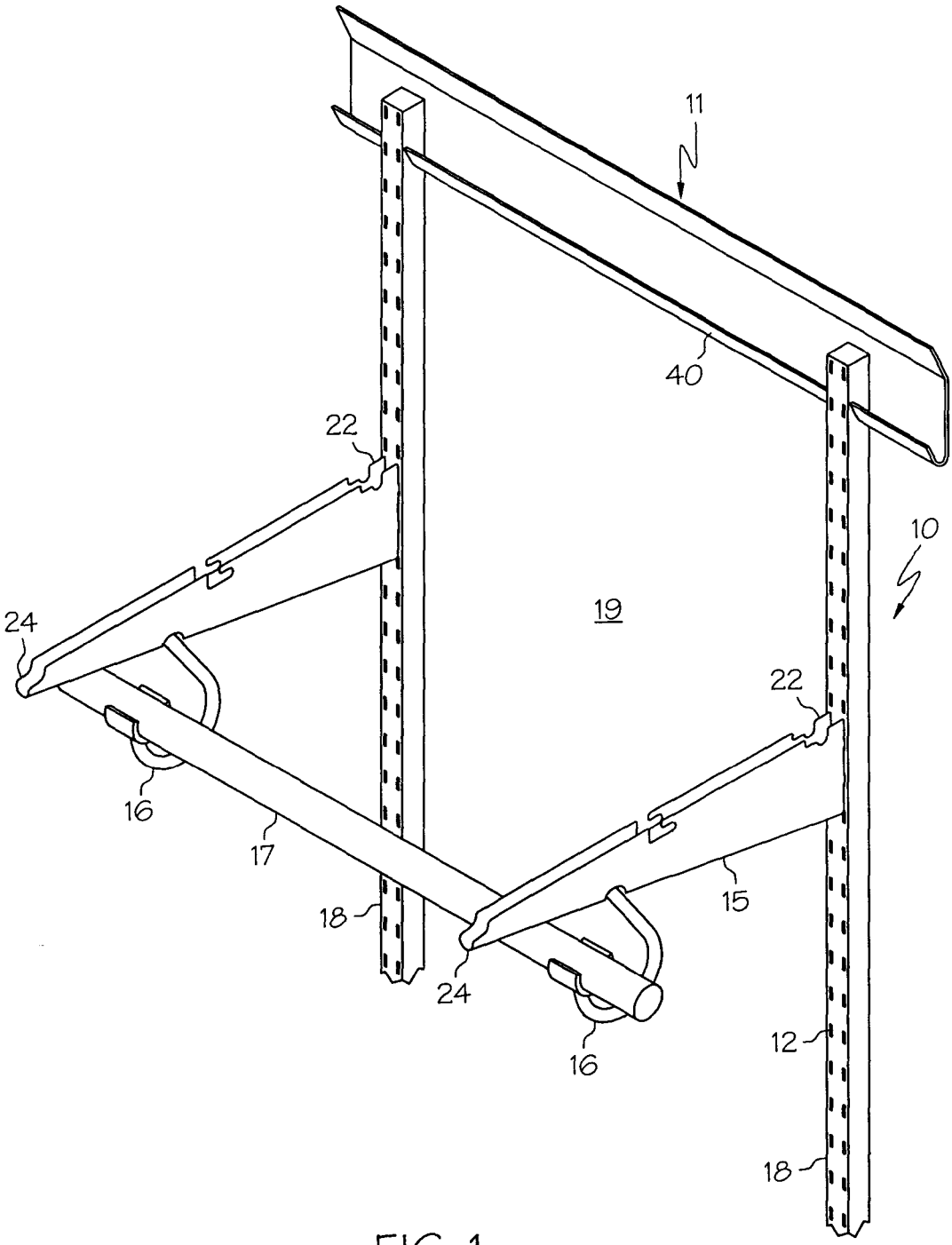
FIG. 1 depicts an exemplary support assembly in accordance with one embodiment of the present invention.

FIG. 1 depicts an exemplary support assembly 10 in accordance with one embodiment of the present invention. In general, and as will be more fully explained herein, support assembly 10 is configured to support not only a hanger bar (or rod) 17 for clothes hangers to hang (and slide) theron, but also a shelving unit.

In more detail, support assembly 10 comprises a support bracket 15 and a support hook 16. One end portion of the support hook 16 is received by, and secured to, support bracket 15. The other end portion of the support hook 16 is configured to support a hanger bar 17. Support hook 16 is designed to allow hangers positioned on the hanger bar to freely slide along the length of hanger bar 17, with little or no interference from support hook 16.

As will be apparent to one skilled in the art, at least two support hooks 16 and support brackets 15 will typically be required to support a hanger bar 17 and a shelf member. However, in some installations, particularly those only requiring a short hanger bar and shelf member, only one support hook 16 and support bracket 15 may be needed. In these installations, one end of the hanger bar and the shelf member may be supported by one or more brackets which are mounted to a wall or other vertical support. Since brackets 15 also serve to support a shelf member, it is also contemplated that a pair of support brackets 15 may be employed to support the shelf member while only a single support hook 16 is needed to support hanger bar 17 (with one end of the hanger bar supported by a bracket mounted to a wall).

In the embodiment shown in FIG. 1, support bracket 15 is configured to be removably secured to a standard 18 which is attached to a wall 19. As described further herein, standard 18 may be configured such that support bracket 15 may be secured to standard 18 at a variety of locations along the length of standard 18. In this manner, the positioning of support bracket 15 (and hence the hanger bar) may be vertically adjustable relative to the wall 19.

Standard 18 may be secured to a wall 19 by any of a variety of well-known means. In FIG. 1, standard 18 is suspended from a horizontal hanging rail 11 which is secured to wall 19. Hanging rail 18 may be attached to wall 19 using screws or other suitable fasteners which extend through apertures in standard 18 into wall 19. Hanging rail 18 includes a lower upturned flange 40 which is configured to engage similarly angled slots which extend upwardly away from the rear face of standard 18, adjacent the upper end of standard 18. In such an arrangement, standard 18 may be slid along the length of hanging rail 11, thus providing horizontal adjustability of standard 18. Alternatively, standard 18 may simply be secured to wall 19 using fasteners (such as screws) which extend through apertures in standard 18 into wall 19.

Figure 2A:
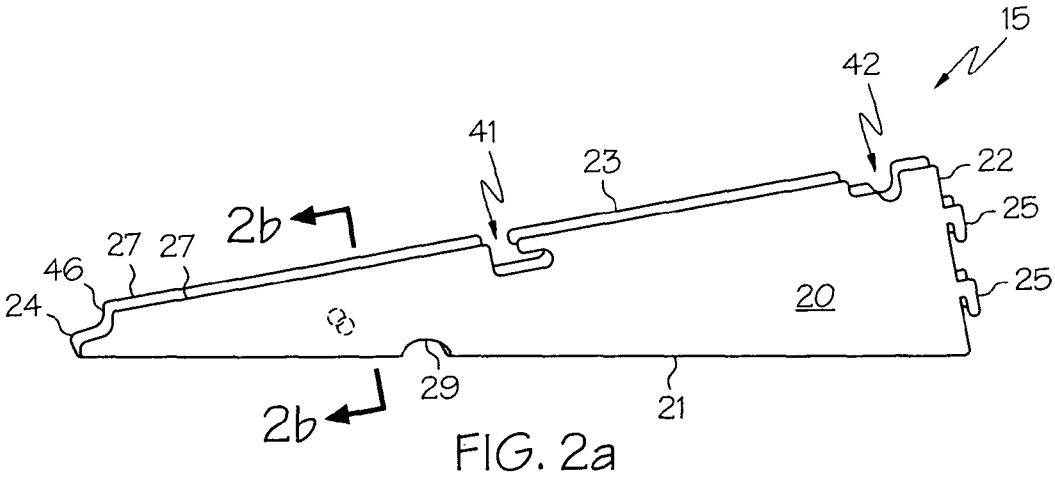
FIG. 2*a* is a side perspective view of the support bracket shown in FIG. 1.
Figure 2B:
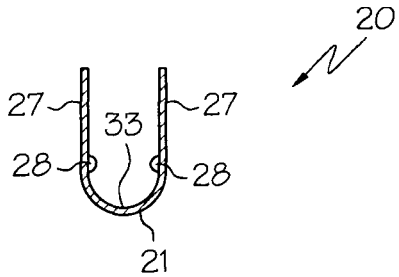
FIG. 2*b* is a cross-sectional view of the support bracket of FIG. 2*a*, taken along the line 2*b*—2*b* thereof.
Figure 2C:
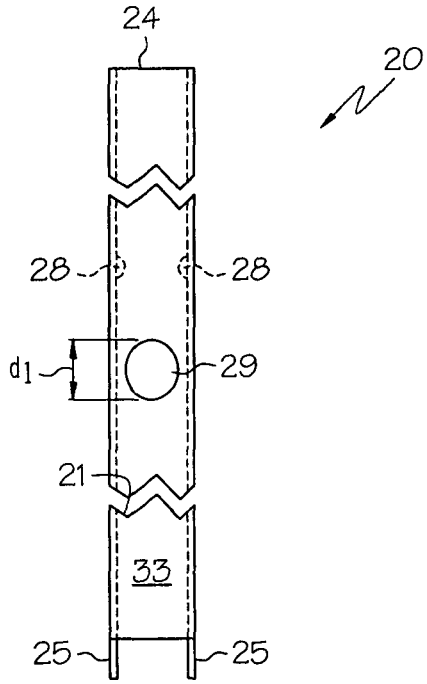
FIG. 2*c* is a partial bottom plan view of the support bracket of FIG. 1.

FIGS. 2*a*, 2*b* and 2*c* depict an exemplary embodiment of the support bracket 15 of FIG. 1 in accordance with one embodiment of the present invention. Support bracket 15 comprises a body 20 which includes opposing side walls 27 which are joined to one another via bottom wall 21. In the exemplary embodiment shown, bracket 15 is formed from a single sheet of metal (or other suitable material), and side walls 27 and bottom wall 21 can be formed merely by bending the metal to the desired cross-sectional shape. In the embodiment shown, body 20 generally has a U-shaped cross-sectional shape (as shown in FIG. 2*b*). However, one of ordinary skill in the art will recognize that body 20 may be configured in a variety of other cross-sectional shapes. Body 20 also generally includes a proximal portion or end 22, and a distal portion or end 24.

Figure 6:
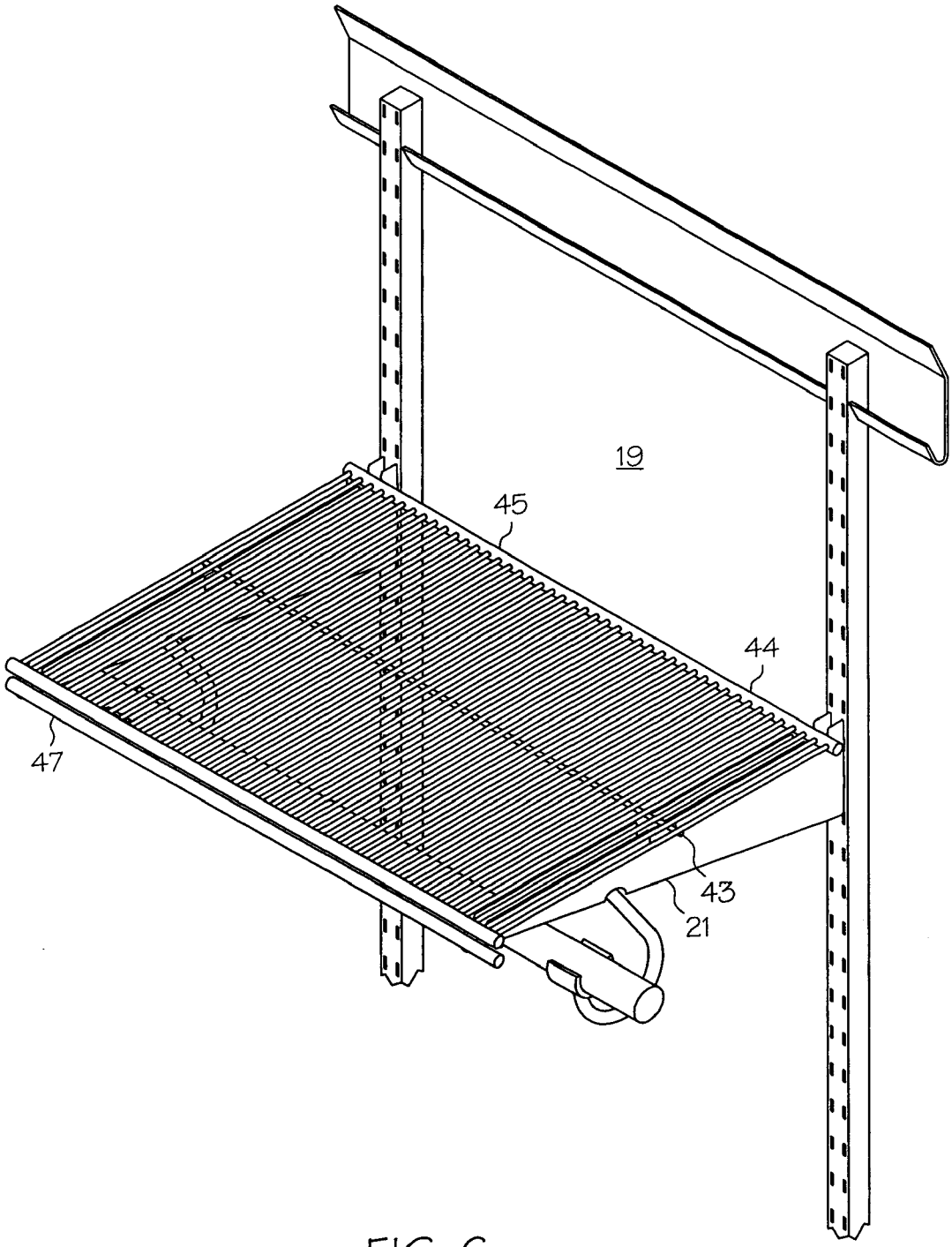
FIG. 6 depicts the support assembly of FIG. 1, with a wire shelving unit installed thereon.

Side walls 27 of bracket 15 each terminate in an upper surface 23 which is configured to support a wire shelf member 45 (as shown in FIG. 6) or a even a solid shelf member (such as a wood shelf comprising a rectangular piece of wood). In the exemplary embodiment shown in FIG. 2*a*, each side wall 27 includes a pair of slots 41 and 42 which extend from upper surface 23. Slots 41 and 42 are each configured to engage a longitudinally extending wire 43 and 44, respectively, of a wire shelving member 45, as shown in FIG. 6. The configuration of slots 41 and 42 is known to those skilled in the art, and is merely exemplary of one possible embodiment. Although slots 41 and 42 will allow wire shelf member 45 to be removeably secured bracket 15, they will not interfere with the use of a solid shelf member. A solid shelf member may be secured to bracket 15 by any of a variety of conventional means known to those skilled in the art. A notch 46 may also be provided in each side wall 27 at the distal end thereof such that notches 46 will receive the forwardmost longitudinally extending wire 47 of wire shelving member 45 (see FIG. 6).

Bottom wall 21 of the exemplary embodiment shown in FIGS. 2*a–c* may have a substantially semi-circular shape, and includes an inner surface 33. An aperture 29 is also provided in bottom wall 21, as shown. Each side wall 27 also includes a protrusion (or dimple) 28 which extends inwardly into the interior of body 20. Protrusions 28 may be identically positioned on each opposing side wall 27, adjacent inner surface 33 and forward of aperture 29. In this instance, "forward" simply means that protrusions 28 are located nearer to distal end 24 than aperture 29 is.

In the exemplary embodiment shown, aperture 29 may be substantially circular in shape and have a diameter "$d_1$". Additionally, aperture 29 is positioned toward the distal end 24 of body 20 so that a hanger bar 17 may be positioned below the front edge of a shelving unit positioned on upper surface 23. In this manner, a user of the hanger bar will be provided with easy access to clothes hung on the bar. It will be understood, however, that aperture 29 may be positioned anywhere along bottom wall 21 of body 20, as desired. In most instances, it would be preferred that aperture 29 is located on the forward half of bracket 15 (i.e., nearer to distal end 24 than to proximal end 22). In addition, aperture 29 may have a variety of shapes, such as the same cross-sectional shape as support hook 16 (e.g., circular or elliptical).

As further depicted in FIGS. 2*a* and 2*c*, bracket 15 further includes one or more mounting tabs (or flanges) 25 which extend rearwardly away from the proximal end 22 of sidewalls 27 in the conventional manner. Mounting tabs 25 are configured to removeably engage a series of vertically-extending slots in standard 18, thereby allowing support bracket 15 to be adjustably secured to wall 19 (as shown in FIG. 6). Bracket 15 may include as few or as many mounting tabs 25 as required to secure support bracket 15 to standard 18. In the exemplary embodiment shown in FIGS. 2*a* and 2*c*, a pair of mounting tabs extend away from the proximal end of each side wall 27, thereby allowing bracket 15 to be secured to a conventional standard having two vertically-extending rows of slots (i.e., "twin track" standards). Of course, the number, location and orientation of mounting tabs 25 may be altered depending on, for example, the size and arrangement of slots on the standard.

Figure 3A:
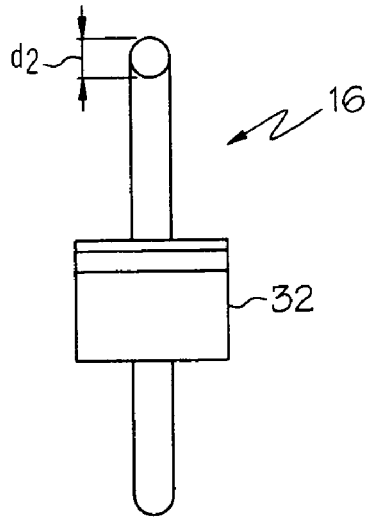
FIG. 3*a* is a front view of the support hook shown in FIG. 1.
Figure 3B:
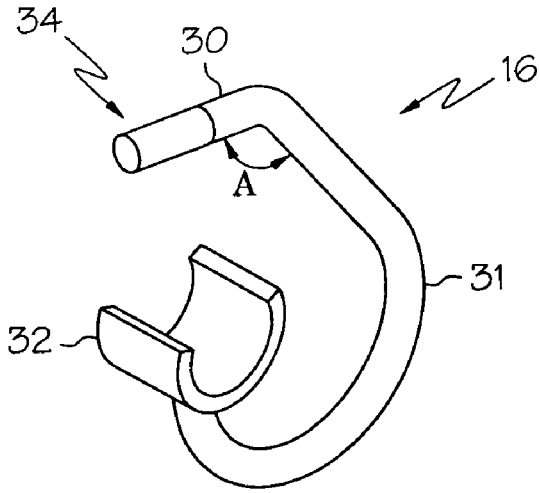
FIG. 3*b* is a side perspective view of the support hook of FIG. 1.

FIGS. 3*a* and 3*b* depict an exemplary embodiment of support hook 16 which may be formed, for example, from a single wire rod. Although one of ordinary skill in the art would recognize that the cross-section of the wire-rod could be virtually any shape, in an exemplary embodiment of the invention the wire-rod has a circular shape having a diameter "$d_2$". It should be recognized that the diameter "$d_2$" of the support hook 16 should be sufficient to support the anticipated weightload on hanger bar 17 such that the support hook 16 will not break or deform during use.

Although support hook 16 (except support member 32) is contemplated as being fabricated from a single wire rod, support hook 16 can be described by three portions: a first (or upper) portion 30, a middle portion 31 and a support (or lower) portion 32. Like the other components of the present invention, support hook 16 may be treated to inhibit corrosion and provide improved aesthetics. For example, support hook 16 may be made from steel or other type of metal, and may be zinc-coated to prevent corrosion. Support hook 16, particularly middle portion 31 and support portion 32, also may be powder-coated or otherwise painted for aesthetic purposes. Powder coating or paint may be omitted from at least the proximal end portion 34 of the first portion 30. One of skill in the art will recognize that support hook 16 may be fabricated in separate portions which are subsequently fastened to one another by screwing, interlocking, welding, adhesively-bonding or otherwise securely connecting the portions together.

The first (or upper) portion 30 of the support hook 16 is configured to be securely and removably attached to the body 20 of the support bracket 15. The first portion 30 of the support hook 16 is configured to be inserted through aperture 29 in bottom wall 21 of support bracket 15. It should be recognized that the cross-sectional shape of support hook 16 may correspond to the shape of the aperture 29, and the diameter "$d_2$" of the support hook 16 may substantially correspond in size to (or be slightly smaller than) the diameter "$d_1$" of the aperture. In this manner, lateral movement of support hook 16 within aperture 29 will be limited. In other words, the support hook 16 should be capable of freely sliding in and out of aperture 29, but side-to-side, or lateral movement while received in aperture 29 should be limited.

The middle portion 31 of the support hook 16 is designed so as to allow sliding movement of a hanger across the hanger bar 17 without interference. To achieve this functionality, the middle portion 31 of the exemplary support hook 16 in FIG. 3*a* is designed with generally a crooked J-shape. When viewed in the side-view of FIG. 3*b*, with the first portion 30 of the support hook 16 extending generally horizontally, the middle portion 31 extends downwardly and rearwardly away from horizontal first portion 30 at an angle A of between 90 and 180 degrees, or even between 120 and 150 degrees. In addition to the generally straight portion which extends angularly away from first portion 30, middle portion 31 also includes a substantially U-shaped portion which curves back towards first portion 30. This U-shaped portion generally terminates in an endwall located beneath first portion 30. In this way, the design of the support hook 16 allows unobstructed movement of a hanger across the entire hanger bar 17.

The support (or lower) portion or member 32 of support hook 16 may be secured to the endwall of the U-shaped region of middle portion 31 and is configured to support a hanger bar 17. While one of skill in the art will recognize that the support portion 32 of the support hook 16 could be configured in any variety of ways, in an exemplary embodiment of the invention, the support portion 32 of the support hook 16 may comprise a semi-cylinder (or substantially U-shaped member) configured to provide an appropriate resting place for hanger bar 17. Support portion 32 may be secured to the end of the middle portion 31 by welding, adhesive-bonding and the like. To secure the hanger bar 17 to support portion 32, a screw or other fastener may extend through one of hanger bar 17 and support portion 32 into the other. Of course, hanger bar 17 may also merely rest on top of support portion 32, and support portion 32 may even be configured to provide a press or snap-fit between hanger bar 17 and support portion 32. For example, support portion 32 may comprise a semi-cylindrical member which is sized and configured such that a hanger bar 17 may be snapped into this semi-cylindrical member. In an alternate embodiment of the invention, the support hook 16 may not comprise a U-shaped support portion 32 for resting the hanger bar 17, but rather the hanger bar 17 may be welded or adhesively bonded directly to the endwall of middle portion 31 of the support hook 16.

In yet another embodiment, the support hook 16 may be designed and fabricated in separate, connectable portions, such as portions that are configured to be screwed together or otherwise releasably attachable. In this embodiment, U-shaped support portion 32 could be designed having various sizes and configurations that may each be interchangeable with the middle portion 31 to provide a plurality of possible choices of configurations for a user. For example, the U-shaped support portion 32 could be designed to accommodate various diameters of hanger bars 17, or could be designed with various decorative or ornamental characteristics.

Figure 4:
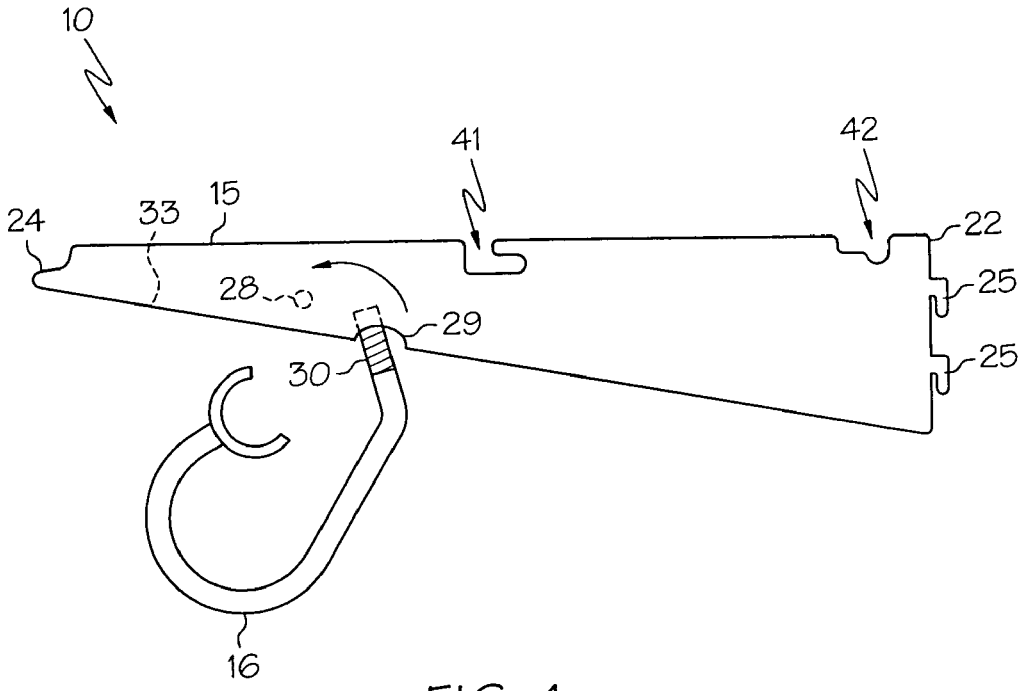
FIG. 4 depicts the method of securing the support hook to the support bracket for the exemplary embodiment of FIG. 1.

FIG. 4 depicts the exemplary support bracket 15 receiving the exemplary support hook 16. It should be recognized from the foregoing that aperture 29 of the support bracket 15 is configured to receive the first portion 30 of the support hook 16. To connect the support hook 16 to the support bracket 15, first portion 30 of support hook 16 is inserted into aperture 29, as shown. The first portion 30 of support hook 16 is then rotated counter-clockwise to a position where the first portion 30 contacts the two opposing protrusions 28 located on the inner side-walls of body 20. To overcome the two opposing protrusions, a counter-clockwise rotational force can be further be applied to the support hook 16, thereby causing the sidewalls of body 20 to flex a sufficient amount to allow first portion 30 of the support hook 16 to advance past protrustions 28. In this manner, first portion 30 will "snap" into place, and the protrusions 28 will act to hold first portion 30 of the support hook securely against the inner lower surface 33 of the body 20 (see FIGS. 5*a* and 5*b*).

Figure 5A:
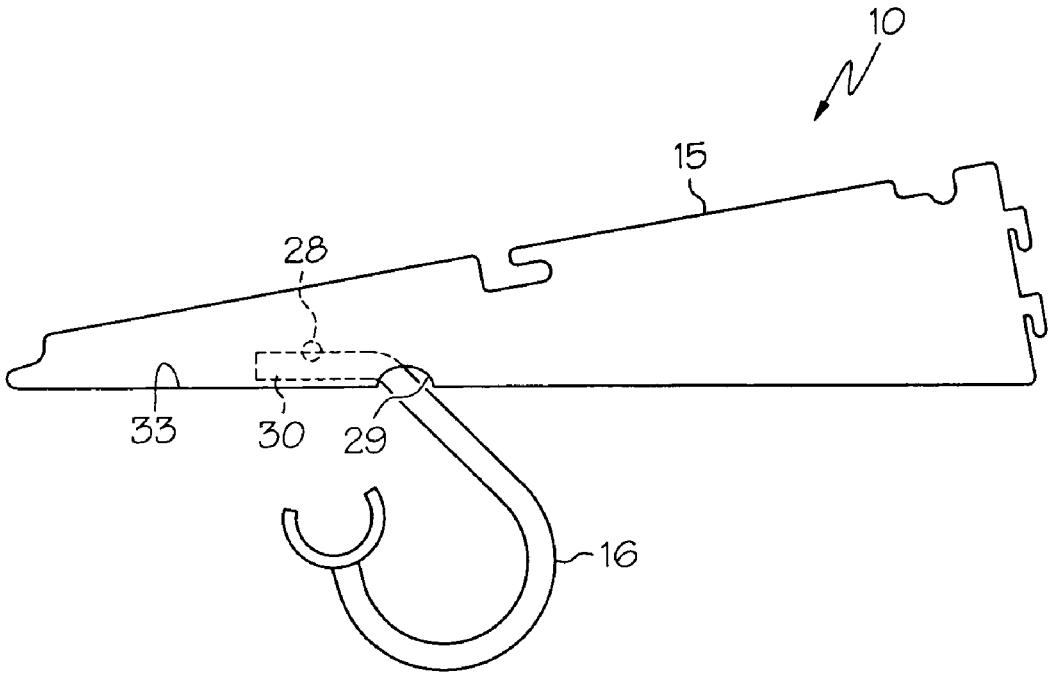
FIGS. 5*a* and 5*b* depict the support assembly of FIG. 1, as assembled, with FIG. 5*b* providing a cross-sectional view.
Figure 5B:
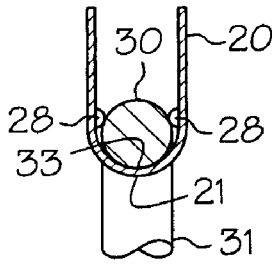

FIGS. 5*a* and 5*b* depict the support assembly 10, as assembled, in accordance with one embodiment of the present invention. In particular, FIGS. 5*a* and 5*b* depict the support hook 16 securely attached within the support bracket 15. In other words, the first portion 30 of the support hook 16 is received in the aperture 29 of the support bracket 15 and secured within support bracket 15 by protrusions 28. It should be recognized that the shape of the inner lower surface 33 of the body 20 may substantially correspond to the cross-sectional shape of the first portion 30 of the support hook 16 to allow the support hook 16 to fit "snuggly" between the protrusions 28 and the inner lower surface of the body 20 (see, e.g., FIG. 5*b*). In an exemplary embodiment of the invention, the semi-circular bottom portion of the U-shaped body has a diameter that substantially corresponds to the diameter of the support hook 16 to provide an appropriate fit.

In addition, it should also be noted that the bottom wall 21 of bracket 15 need not be parallel to upper surface 23 of bracket 15. Therefore, when the support assembly is installed as shown in FIG. 6 with the shelf member supported thereby in a horizontal orientation, bottom wall 21 may extend somewhat upwardly away from wall 19 (i.e., not horizontal). Therefore, first portion 30 of support hook 16 will generally extend away from wall 19 at the same angle as bottom wall 21 of bracket 15. However, the angle between first portion 30 and middle portion 31 of support hook 16 may be chosen to ensure that the hanger rod 17 will be supported at the desired location with respect to the shelving member.

Having shown and described the preferred embodiments of the present invention, further adaptations of the support assembly of the present invention as described herein can be accomplished by appropriate modifications by one of ordinary skill in the art without departing from the scope of the present invention. Several of these potential modifications and alternatives have been mentioned, and others will be apparent to those skilled in the art. Accordingly, the scope of the present invention should be considered in terms of the following claims and is understood not to be limited to the details of structure, operation or process steps as shown and described in the specification and drawings.

I claim:

1. A support bracket for a hanger bar, said support bracket comprising:

a body having:

a bottom wall;

opposing side walls extending upwardly from said bottom walls, each sidewall comprising proximate ends having at least one mounting tab extending from a respective side wall in a direction parallel to a longitudinal axis of said body;

an aperture configured to receive a first portion of a support hook, wherein said aperture is located in said bottom wall; and at least two protrusions configured to secure the support hook to said body, said protrusions extending inwardly from respective said side walls adjacent said aperture and located between said aperture and a distal end of respective said side walls, said protrusions and said bottom wall adjacent said aperture are adapted for simultaneously contacting said support hook.

2. The support bracket of claim 1, wherein said body has a substantially U-shaped cross-section.

3. The support bracket of claim 1, wherein each of said opposing side walls has an upper surface configured to support a shelf thereon.

4. The support bracket of claim 3, wherein each of said side walls includes a slot extending from said upper surface thereof, wherein said slots are configured to removably secure a shelf to said support bracket.

5. The support bracket of claim 1, wherein said proximate ends are configured to engage a standard.

6. A support assembly for supporting a hanger bar, the assembly comprising:

a support hook having an upper portion, a lower portion having a semi-cylinder member configured to support a hanger bar and a middle portion between said upper and lower portions which extends away from said upper portion at an angle between 120–150 degrees; and a support bracket comprising a body having an aperture extending through a bottom wall into the interior of said bracket configured to receive said upper portion of said support hook, and at least two protrusions configured to secure said support hook to said body, wherein said upper portion of said hook rests against an interior surface of said bottom wall.

7. The support bracket of claim 6, wherein the size of said aperture substantially corresponds in size to said upper portion of said support hook.

8. The support assembly of claim 6, wherein at least one of said protrusions is positioned on at least one of an opposing side wall of said body.

9. The support assembly of claim 6, wherein the protrusions are configured to hold the upper portion of the support hook securely against an inner lower surface of the body.

10. The support assembly of claim 6, wherein said lower portion of said support is configured to support a hanger bar.

11. The support assembly of claim 6, wherein said support hook further comprises a middle portion configured to allow a clothes hanger to be slid along the length of a mounted hanger bar without obstruction from said support hook.

12. The support assembly of claim 6, wherein the support assembly further comprises a hanger bar.

13. The support assembly of claim 6, wherein said middle portion is configured to allow a hanger to move across the supported hanger bar.

14. The support assembly of claim 6, wherein said semi-cylinder member is substantially U-shaped.

15. The support hook of claim 14, wherein said middle portion is substantially J-shaped.

16. A support assembly for supporting a hanger bar, the assembly comprising:

a support hook having an upper portion, a lower portion having a semi-cylinder member configured to support a hanger bar and a middle portion between said upper and lower portions which extends away from said upper portion at an angle between 120–150 degrees; and a support bracket comprising a body having an aperture configured to receive said upper portion of said support hook, and at least two protrusions configured to secure said support hook to said body, wherein said body of said support bracket has opposing side walls, a semi-circular bottom wall, and a substantially U-shaped cross-section.

17. The support assembly of claim 16, wherein said semi-circular bottom wall of said body has a diameter that substantially corresponds to said upper portion of said support hook.

* * * * *